US005498309A

United States Patent [19]

Greten et al.

[11] Patent Number: 5,498,309

[45] Date of Patent: Mar. 12, 1996

[54] APPARATUS FOR CONTINUOUSLY PRODUCING PLATES HAVING A STRUCTURED SURFACE

[75] Inventors: Berndt Greten; Günter Seeger; Klaus Poppelreuter, all of Springe, Germany

[73] Assignee: Bison-Werke Baehre & Greten GmbH & Co. KG, Springe, Germany

[21] Appl. No.: 234,898

[22] Filed: Apr. 28, 1994

Related U.S. Application Data

[62] Division of Ser. No. 987,478, Dec. 7, 1992, Pat. No. 5,322,577.

[30] Foreign Application Priority Data

| | | | |
|---|---|---|---|
| Dec. 12, 1991 | [DE] | Germany | 41 40 982.5 |
| Aug. 8, 1992 | [DE] | Germany | 42 27 224.6 |
| Sep. 2, 1992 | [DE] | Germany | 42 29 284.0 |

[51] Int. Cl.[6] ..... B30B 5/04

[52] U.S. Cl. ..... 156/347; 156/346; 156/555; 156/583.5; 425/371

[58] Field of Search ..... 156/62.2, 555, 156/209, 553, 583.3, 346, 347, 583.5; 425/371

[56] References Cited

U.S. PATENT DOCUMENTS

| | | | |
|---|---|---|---|
| 2,246,987 | 6/1941 | Roos | 156/347 |
| 3,177,558 | 4/1965 | Gronholz et al. | 425/471 |
| 3,718,536 | 2/1973 | Downs et al. | 156/62.2 |
| 4,017,248 | 3/1977 | Dieffenbacher et al. | 425/371 |
| 4,277,428 | 7/1981 | Luck et al. | 264/118 |
| 4,420,357 | 12/1983 | Neubauer et al. | 156/583.5 |
| 4,557,778 | 12/1985 | Held | 156/209 |
| 4,645,632 | 2/1987 | Böttger et al. | 156/583.5 |
| 4,699,676 | 10/1987 | Held | 156/555 |
| 4,988,845 | 1/1991 | Bauer et al. | 219/121.63 |

FOREIGN PATENT DOCUMENTS 31613 7/1981 European Pat. Off. .

*Primary Examiner*—Jeff H. Aftergut
*Assistant Examiner*—Richard Crispino
*Attorney, Agent, or Firm*—Townsend and Townsend and Crew

[57] ABSTRACT

Particle boards having at least one surface made of a resin impregnated paper web are provided during their production with a surface structure due to the fact that a glass sphere blasted surface structure is provided for in the pressing surface of a double band press.

15 Claims, 2 Drawing Sheets

Figure 2:
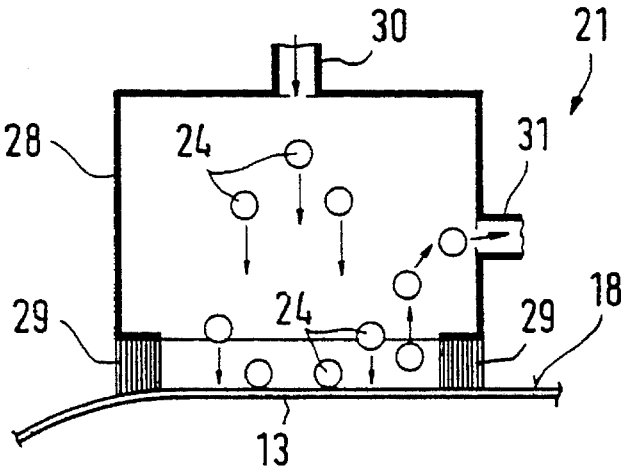

Fig.1
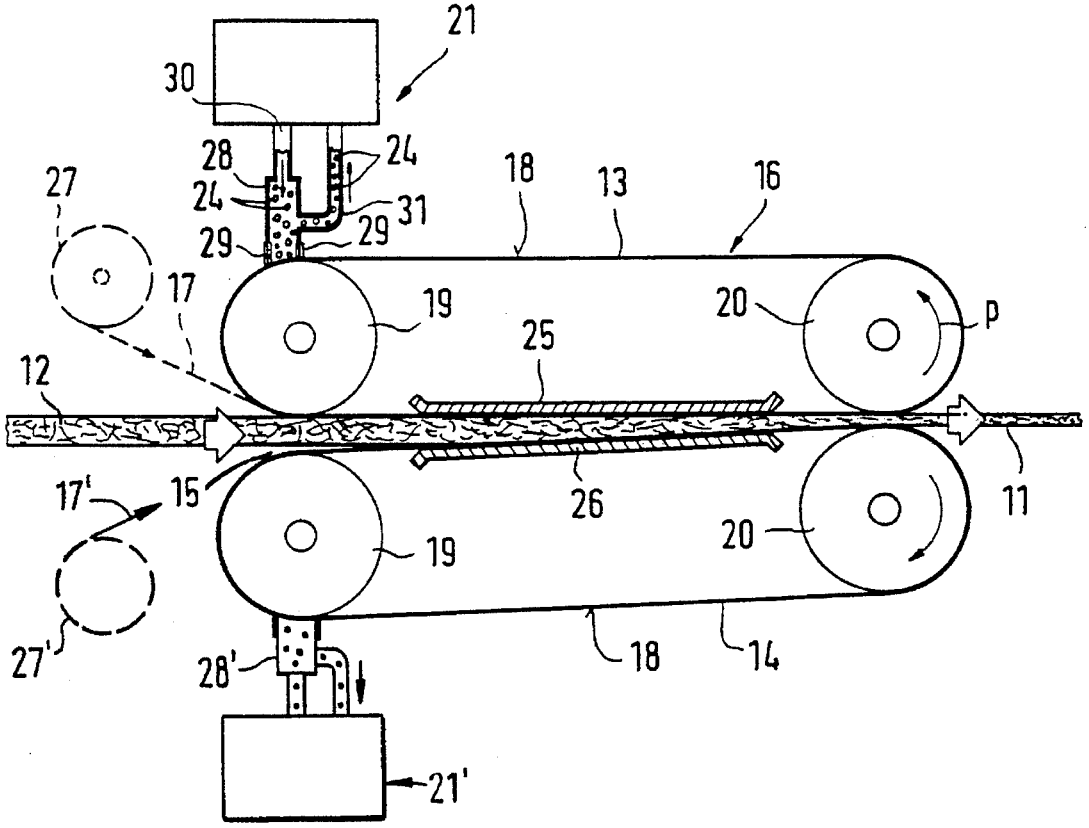
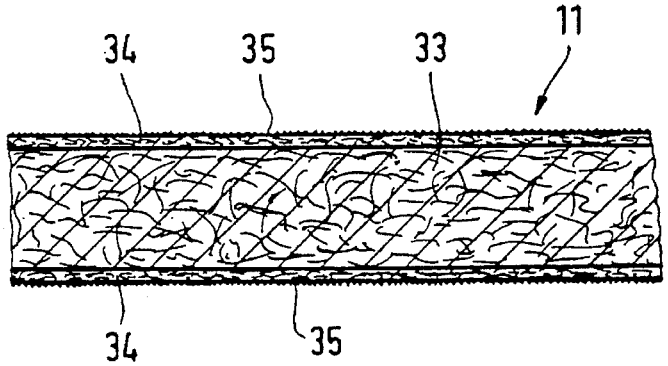
Fig.4

APPARATUS FOR CONTINUOUSLY PRODUCING PLATES HAVING A STRUCTURED SURFACE

This is a division of application Ser. No. 07/987,478, filed Dec. 7, 1992, now U.S. Pat. No. 5,322,577.

DESCRIPTION

The invention relates to a method and to an apparatus for continuously producing plate webs having a structured surface. It also relates to particle plates produced thereby and to an endless press band for carrying out the method, as well as a band press equipped with such an endless press band.

In order to structure the surface of particle boards during their production, it is already known (DE-OS 32 49 394) to introduce a specially embossed band together with the mat between the two endless press bands of a double band press. The surface structure of the embossing band can be realized by grinding, sand blasting, sphere blasting, thermal spraying of a metal alloy, shaping under pressure with a profiled cylinder or drum, etching, multiple step etching, or the like.

The requirement of a special embossed band represents an increased expense and complexity for the apparatus and the method. Further, the surface structures which can be obtained with the prior known embossed band on a particle board covered with a resin-impregnated paper band are not appropriate to achieve the fine structure required for avoiding glance or excessive surface polish, without producing simultaneously deeper impressions or other irregularities.

The object of the invention is in particular to realize a particularly economical method which ensures a universal surface structuring and a particularly polymorphic finishing degree of plate surfaces and allows to keep the apparatus and operation costs to a low level.

The features and apparatuses provided for in accordance with the invention in order to solve this problem are indicated in the claims.

Some particular advantages of the invention will be indicated in the following.

Owing to the realization of a substantially glass sphere blasted surface structure of the pressing surface, which has a low roughness depth, one obtains on the one hand a very low weakening of the press band, and on the other hand particle plate surfaces which are particularly finely mat.

It is expedient to select the fine roughness of the pressing surface in the region of an existing welding seam in the same manner as on the other locations of the endless press band, wherefore the Weld seam must be smoothly ground and/or polished before the blasting.

The kind of embossing of the endless bands of the invention, which can take place on the band press itself is particularly advantageous. Therefore, the band press serves simultaneously as part of the apparatus for producing the endless bands. It is further advantageous that the press surfaces of an endless press band, which are worn out after a long period of operation, can be refinished at any time. The use of the band press itself as a portion of the apparatus for producing the surface structure is thus advantageous, not only for the first finishing of the press band, but also for refinishing, for which it is only necessary to mount the glass sphere blasting device in the region of one of the deflection cylinders, whereas the endless bands themselves must not be removed or specially arranged in any manner.

The continuous surface structuring by means of the endless press bands can be followed by the discontinuous method steps of dividing the press band into individual plates. In this case, the turning device for the individual press band has a star shaped cross sectional profile. This enables air to have free access to the turned hot plates on all sides. These plates are stapled to the band. In a second short cycle pressing operation, during which the temperature is preferably about 180° C. and the exerted pressure is in the range of about 6 bar to 8 bar, each plate is subjected at least on one side to a further relief-like surface structuring. This relief-like surface structuring is in the manner of a wood texture, schist texture, sandstone, or fancy structure and the like, with or without an embossed surface structure, which makes it again possible to achieve a significant increase in the economy and a finishing degree of plate surfaces which satisfies the highest requirements.

Figure 3:
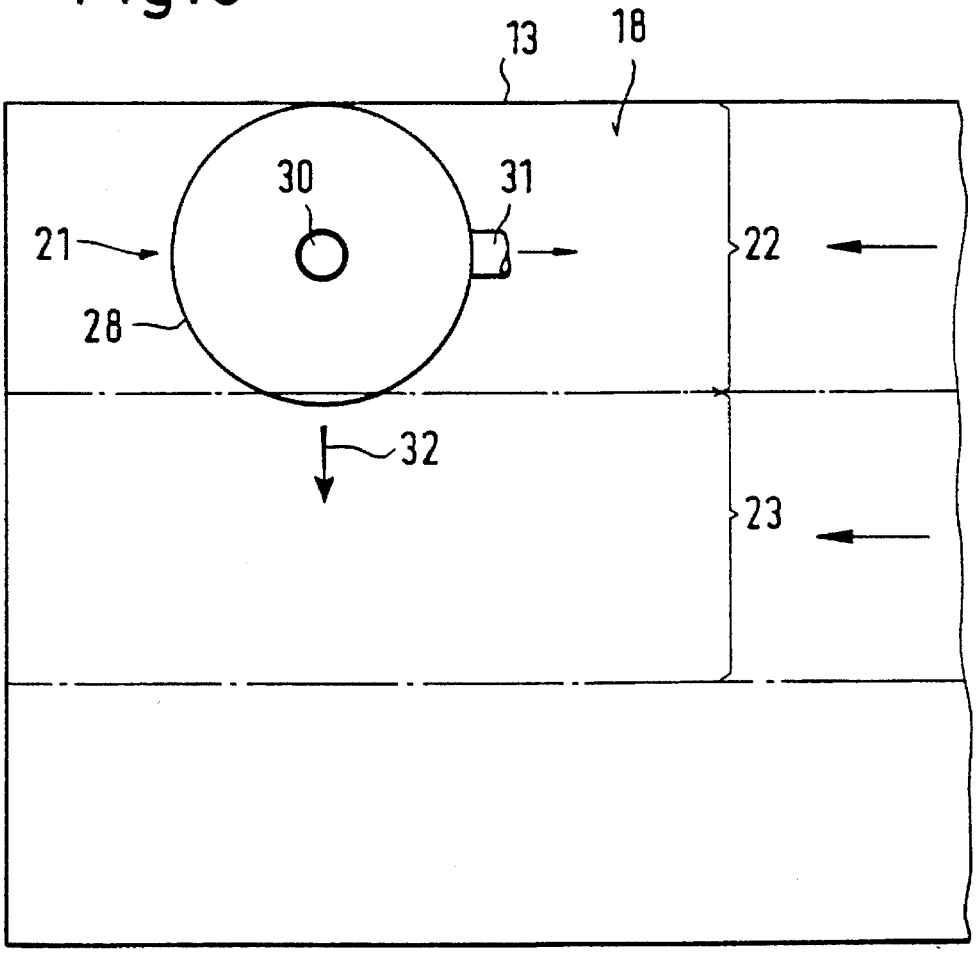

The invention will be described thereafter by way of example and with reference to the drawings; the latter show:

FIG. 1 a schematic side view of a double band press of the invention, which is simultaneously used as apparatus for producing a surface structure;

FIG. 2 an enlarged and partly cut away side view of the glass sphere blasting device of FIG. 1;

FIG. 3 a schematic upper view of the apparatus of FIG. 1; and

FIG. 4 a schematic cross section of a particle board of the invention.

FIG. 1 shows in a very schematized form a double band press 16 comprising two endless press bands 13, 14, which are placed around deflecting cylinders 19, 20 and form a pressing gap 15 by means of two runs facing each other at a small distance. The pressing and heating means which bias the two flights defining the pressing gap 15 are indicated by the references 25, 26.

In a known manner, a mat 12 comprising ligno-cellulose and/or cellulose-containing chips or fibres bound with a binding agent is introduced into the pressing gap 15 of such a double band press 16, and this mat is formed and pressed in the double band press 16 to a particle board web 11. A resin impregnated paper web 17 is introduced into the pressing gap 15 together with the mat 12, the paper web being unrolled from an appropriately arranged reserve roll 27. The same resin impregnated paper web 17' can be introduced in the opposite side from a similar reserve roll 27'.

Before putting the double band press 16 into operation in the above described manner, the pressing surface 18 of the upper endless press band 13 is provided, in accordance with FIGS. 1, 2 and 3, with a surface structure having a roughness depth of less than 100 μm by means of a glass sphere blasting device 21. The glass sphere blasting device 21 is arranged above the upper left deflection cylinder 19 and comprises a sphere blasting nozzle 28 which is arranged directly above the pressing surface 18. The sphere blasting nozzle 28 is sealed from the environment by means of surrounding brushes 29 or similar, which engage the pressing surface 18.

Glass spheres 24 having a diameter of about 0.2 mm are supplied by means of a glass sphere supply tube 30 (FIGS. 1, 2) into an air stream having a pressure of 3 bar to 5 bar into the nozzle 28, from which they impinge with a high speed onto the pressing surface 18 within the surrounding seal formed by the brushes 29 and realize there a characteristic fine surface structure. Owing to the high speed and to the special rebouncing behavior of glass spheres on the surface of stainless steel, the glass spheres are fastly returned after having impinged onto the pressing surface 18 and are sucked off by means of a sucking tube 31 provided laterally on the nozzle 28, and returned into the blasting device 21. The glass spheres can be supplied to the latter for reuse.

In accordance with FIG. 3, the blasting nozzle 28 has a circular cross section and is firstly applied in the region of one edge of the endless press band 13, as indicated in FIG. 3. Thereafter, the endless press band 13 is displaced in the direction of the arrow p in FIG. 1 in a slow movement, whereupon the blasting device 21 is put into operation. In this manner a strip 22 extending all around the endless press band 13 is progressively structured at its surface in the desired manner (FIG. 3).

After the endless press band 13 has made one revolution, i. e. the strip 22 has been entirely finished, the blasting nozzle 28 is displaced laterally over approximately its diameter in the direction of the arrow 32 in FIG. 3, whereupon an adjacent strip 23 is then blasted in a corresponding manner.

This operation mode is continued until the pressing surface 18 is finished over its entire width. It is important that the adjacent strips, for example 22, 23, overlap to some extent in order to obtain a regular surface structure also in the border region.

It is also imaginable to displace the blasting nozzle 28 continuously over the pressing surface 18 back and forth in the direction of the arrow 32 or in the opposite direction while the endless press band 13 slowly circulates.

The pressing surface of the lower endless press band 14 could also be provided with a surface structure in a corresponding manner, wherefore it would be necessary to apply the blasting nozzle 28' in the region of the deflection cylinder 19 or 20 with a certain inclination from above onto the pressing surface.

Before carrying out the glass sphere blasting, the press bands delivered by a manufacturer are firstly formed into the endless press bands 13, 14 by laying them around the deflection cylinders 19, 20 and welding their free ends together. Thereafter, the finishing is continued by realizing the surface structure by means of the glass sphere blasting.

After finishing the surface structure on one or both pressing surfaces 18, the blasting device 21 is removed and the production sequence of the particle boards described at the beginning can now be started.

Pressing surface 18 is blasted with spheres, with a roughness depth preferably less than or equal to 100 μm. This pressing surface is made in particular of steel without chromium plating and having preferably a thickness of 0.5 mm to 2.5 mm and in particular 2 mm.

The weld seam is made at least substantially of the same metal as the remainder of the band. The respective ends of the endless press band are preferably welded by means of a laser beam.

The glass spheres 24 are blasted perpendicularly onto the press surface 18 and are preferably supplied towards the pressing surface in an air stream having a pressure from 2 bar to 10 bar, in particular about 3 bar to 5 bar.

The glass spheres have a size of 0.1 mm to 1 mm, in particular 0.2 mm to 0.5 mm. The glass sphere flow at the level of the pressing surface 18 has preferably a width of 5 cm to 15 cm, in particular about 10 cm.

FIG. 4 shows a particle board 11 of the invention, which comprises a central part 33 made of wood chips or wood fibres held together by a binding agent, and which is covered on both sides with a resin impregnated paper web 34.

Owing to the method of the invention, a surface structure 35 is present on the surfaces of the paper webs 34, which has been produced by the blasted pressing surfaces 18 of the band press 16 of FIG. 1, and has a characteristic design caused by the glass sphere blasting, which can be designated as very fine and regular fine mat finish or very fine and regular roughness.

After the surface structuring during the pressing operation by means of one or two metallic endless press bands, the plate web obtained at the outlet of the pressing gap can be subjected to a further relief-like surface structuring. This occurs on at least one side in a second pressing operation during which temperatures of preferably up to about 200° C. are used. Relief-like surface structuring in the manner of a wood texture, a schist texture, a sandstone or a fancy structure and similar, with or without an embossed surface structure can be attained.

For example, the plate web obtained after the continuous surface structuring during the pressing operation by means of one or two metallic endless press bands at the outlet of the press gap can De divided into individual plates. These individual plates can arrive directly thereafter successively into a turning device having a star-shaped cross section, also called cooling turning apparatus. Free environment air has a free access to the hot plates, preferably on all sides. The plates are stacked, and thereafter in a second short-cycle pressing operation, during which the temperature is preferably about 180° C. and the exerted pressure is in the range of about 6 bar to 8 bar, each plate is subjected at least on one side to a further relief-like surface structuring. This further relief-like structuring can be in the manner of a wood texture, schist texture, sandstone or fancy structure and the like, with or without an embossed surface structure.

We claim:

1. Pressing apparatus for embossing an untextured mat of lignocellulose and/or cellulose bound with a binding agent to produce a particle board with a structured surface, the apparatus comprising;

a continuously operating band press having at least one endless metallic press band and a pressing gap;

means for heating at least one endless metallic press band during pressing by said endless metallic press band on said mat while said continuously operating band press operates;

means for feeding said mat together with at least one resin impregnated paper web contacting at least one face of said mat through said pressing gap of said continuously operating band press;

said endless metallic press band having an irregular surface confronting said at least one resin impregnated paper web and said irregular surface having been formed by its having been blasted with glass beads: and, a glass sphere blasting device mounted to direct glass spheres on said irregular surface of said at least one endless metallic press band.

2. Pressing apparatus in accordance with claim 1, wherein said irregular surface has roughness depth of less than 100 μm.

3. Pressing apparatus in accordance with claim 2, wherein said endless metallic press band has a thickness in the range 0.5 mm to 2.5 mn.

4. Pressing apparatus in accordance with claim 3, wherein said thickness is substantially 2 mm.

5. Pressing apparatus in accordance with claim 1, wherein said endless metallic press band includes at least one transversely extending weld seam, said weld seam being of substantially the same metal as the remainder of said band.

6. Pressing apparatus in accordance with claim 5, wherein said weld seam of said endless metallic press band is formed by means of a laser beam.

7. Pressing apparatus in accordance with claim 1 with further comprising means for carrying out a second pressing operation on said mat of material following said first said pressing operation.

8. Pressing apparatus in accordance with claim 7, wherein said means for subjecting said mat to a second pressing operation comprises a discontinuously operating one-step cycle press.

9. Pressing apparatus in accordance with claim 1, wherein means is provided for moving said glass sphere blasting device transverse to said endless metallic press band.

10. Pressing apparatus in accordance with claim 1 wherein said glass sphere blasting device is adapted to direct glass spheres perpendicularly onto said at least one endless metallic press band in an air stream having a pressure in the range 2 to 10 bar.

11. Pressing apparatus in accordance with claim 10, wherein said pressure lies in the range from 3 bar to 5 bar.

12. Pressing apparatus in accordance with claim 10, wherein said glass bead blasting device is adapted to direct a flow of glass spheres onto said at least one endless metallic press band, with said flow having a width in the range from 5 cm to 15 cm.

13. Pressing apparatus according to claim 10, wherein means are provided for sucking away glass spheres which have been blasted onto said endless metallic press band immediately after said glass spheres have rebounded from said at least one endless metallic press band.

14. Pressing apparatus in accordance with claim 1, wherein said glass spheres have a size in the range from 0.2 mm to 1 mm.

15. Pressing apparatus in accordance with claim 14, wherein said glass spheres have a size in the range from 0.2 mm to 0.5 mm.

* * * * *